US006310010B1

(12) United States Patent
Higton et al.

(10) Patent No.: US 6,310,010 B1
(45) **Date of Patent: *Oct. 30, 2001**

(54) HIGH MOLECULAR WEIGHT DISPERSANT COMPOSITIONS AND THEIR PREPARATION

(75) Inventors: Gary Higton, Oxford (GB); Jacob Emert, Brooklyn, NY (US); Robert A. Wilkinson, Newbury; Isabel P. MacDonald, East Hendred, both of (GB); Karl J. Van Driesen, North Brunswick, NJ (US); Salvatore Rea, Franklin Square, NY (US); James P. Stokes, Annandale, NJ (US); Andrew J. D. Ritchie, Chatham, NJ (US)

(73) Assignee: Exxon Chemicals Patents INC, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/291,578

(22) Filed: Apr. 9, 1999

(30) Foreign Application Priority Data

Apr. 9, 1998 (GB) ..... 9807731

(51) Int. Cl.[7] ..... C10M 165/00

(52) U.S. Cl. ..... 508/192; 508/287; 508/296; 508/372; 508/373; 508/375; 508/391; 508/518; 508/574

(58) Field of Search ..... 508/192, 293

(56) References Cited

U.S. PATENT DOCUMENTS

| | | | | |
|---|---|---|---|---|
| 3,234,131 | | 2/1966 | Morway | 252/40.5 |
| 3,714,042 | | 1/1973 | Greenough | 508/393 |
| 4,938,880 | | 7/1990 | Waddoups et al. | 508/192 |
| 4,981,603 | | 1/1991 | Demange | 508/192 |
| 6,140,279 | * | 10/2000 | Emert et al. | 508/192 |

FOREIGN PATENT DOCUMENTS

| | | |
|---|---|---|
| 865633 | 3/1971 | (CA) . |
| 294096 | 12/1988 | (EP) . |
| 440 508 A2 | 8/1992 | (EP) . |

OTHER PUBLICATIONS

"Small angle neutron scattering studies on non–aqueous dispersions of calcium carbonate," I. Markovic, R.H. Ottewill, D.J. Cebula, I. Field and J.F. Marsh, Colloid & Polymer Science, vol. 262, No. 8, pp. 648–656 (1984).

"Alternative approach to blending," Isabel P. MacDonald, Exxon Chemical Limited memorandum with one attachment, (fifteen pages total), Feb. 12, 1996.

* cited by examiner

*Primary Examiner*—Ellen M. McAvoy

(57) ABSTRACT

Concentrates for lubricating oil compositions are prepared by mixing at elevated temperature: (i) at least one high molecular weight ashless dispersant; (ii) at least one oil-soluble overbased metal detergent; and (iii) at least one surface-active agent comprising a low molecular weight hydroxyl or amine group.

25 Claims, No Drawings

HIGH MOLECULAR WEIGHT DISPERSANT COMPOSITIONS AND THEIR PREPARATION

FIELD OF THE INVENTION

This invention relates to oleaginous compositions useful in fuel and lubricating oil compositions. More particularly, this invention relates to oleaginous concentrates containing high molecular weight dispersants and their preparation thereof.

BACKGROUND OF THE INVENTION

This invention relates to lubricating oil compositions, e.g. automatic transmission fluids, heavy duty oils suitable for gasoline and diesel engines and cranckcase oils. These lubricating oil formulations conventionally contain several different types of additives that will supply the characteristics that are required in the formulations. Among these types of additives are included viscosity index improvers, antioxidants, corrosion inhibitors, detergents, dispersants, pour point depressants, antiwear agents, etc.

In the preparation of lubricating oil compositions, it is common practice to introduce the additives in the form of 10 to 80 mass %, e.g. 20 to 80 mass % active ingredient concentrates in hydrocarbon oil, e.g. mineral lubricating oil, or other suitable solvent. Usually these concentrates are subsequently diluted with 3 to 100, e.g. 5 to 40 parts by weight of lubricating oil, per part by weight of the concentrate to form finished lubricating oil compositions.

It is convenient to provide a so-called "additive package" comprising two or more of the above mentioned additives in a single concentrate in a hydrocarbon oil or other suitable solvent. However, a problem with preparing additive packages is that some additives tend to interact with each other. For example, dispersants having a high molecular weight or a high functionality ratio, for example, of 1.3 or higher, have been found to interact with other additives in additive packages, particularly overbased metal detergents. This interaction causes a viscosity increase upon blending, which may be followed by subsequent growth or increase of viscosity with time. In some instances, the interaction results in gelation. The viscosity increase can hamper pumping, blending and handling of the additive package. Although the additive package can be further diluted with more diluent oil to reduce viscosity in order to offset the effect of interaction, dilution reduces the economy of using an additive package by increasing shipping, storage and other handling costs.

U.S. Pat. No. 4,398,880 describes a process for improving the stability of oleaginous concentrates in the form of additive packages comprising ashless dispersants, particularly polyisobutylene containing dispersants, in combination with overbased metal detergents in which the additives are contacted in a lubricating oil basestock at a temperature of from 100° C. to 160° C. for 1 to 10 hours. The resultant heat-treated blend is then cooled to a temperature of 85° C. or below and further mixed with copper antioxidant additives, zinc dihydrocarbyldithiophosphate antiwear additives and, optionally, other additives useful in lubricating oil compositions. The process enables the stability of the additive package to be improved to the extent that the tendency for phase separation is substantially reduced.

However, the molecular weight of the dispersant used in U.S. Pat. No. 4,398,880 is relatively low. The number average molecular weight of the polyisobutylene polymer used in the examples to make the dispersant is only 1725. The resulting dispersant number average molecular weight can be calculated to be approximately 3900 (e.g., 2 moles isobutylene polymer (MW=1725)+2 moles maleic anhydride (MW=98)+1 mole polyethyleneamine (MW=250)=2(1725)+2(98)+1(250)~3900). The significant increase in viscosity due to the dispersant/detergent interaction, which will be described in more detail below, does not occur until the molecular weight of the polyisobutylene derivatized dispersant is much higher (i.e., approximately 7000).

There is a trend in the industry to go to higher molecular weight dispersants because they have improved dispersant properties to satisfy more rigorous performance requirements in the automobile industry. However, when higher molecular weight dispersants are used in concentrates, they interact with the colloidal overbased detergents to form a complex. This complex substantially increases the viscosity of the concentrate, which could result is blending difficulties unless the blending procedure is carefully designed.

Below is a simplified description of a concentrate containing an overbased detergent and an ashless dispersant. When an overbased detergent is added to an oil-based solvent, a colloidal structure forms containing hydrophilic groups and lipophilic groups, where the lipophilic groups extend out in the oil-based solvent. The ashless dispersant also contains hydrophilic groups and lipophilic groups. At sufficient concentrations, the dispersant interacts with the overbased detergent colloidal structure to form a dispersant/detergent complex where the hydrophilic groups of the overbased metal detergent colloidal structure interacts with the hydrophilic groups of the ashless dispersant.

Not wishing to be bound by any theory, it is believed that this dispersant/detergent complex causes an increase in viscosity because lipophilic groups of the ashless dispersant of one complex can interact with lipophilic groups of another complex. This results in an effective high molecular weight aggregate complex that increases the viscosity of the concentrate. The viscosity may rise uncontrollably to the extent that gels may form that are impossible to blend into a finished lubricating oil composition. The latter effect can evidence itself as the Weissenberg Effect. The Weissenberg Effect occurs when the viscosity of the concentrate significantly rises such that composition is seen to rise up the shaft of the mixing blades during blending.

It should be noted that the increase in viscosity would not occur if the concentration of the complex, or the molecular weight of the ashless dispersant in the concentrate is low. If the concentration of the complex is low (i.e., if the concentrate is dilute), there is sufficient space between the complexes such that the lipophilic groups of the dispersants will not interact. Likewise, if the molecular weight of the ashless dispersants is low, the lipophilic groups are too small to interact with each other. Thus, for example, a high molecular weight dispersant in a concentrate that is sufficiently dilute may not have a blending problem because there is sufficient space between the complexes such that an aggregate complex will not form. In contrast, a low molecular weight dispersant could have a blending problem in a highly concentrated composition because the space between the complexes is small. At typical additive package concentrations, the blending problems will not typically occur until the number average molecular weight of the dispersant is over about 7000 for polyisobutylene derivatized dispersants and over about 3000 for poly(alpha-olefin) derivatized dispersants.

However, the additive package concentrate should preferably contain a high molecular weight dispersant to satisfy performance requirements. In addition, the additive package should be highly concentrated to reduce shipping, storage and handling costs. Therefore, it is an objective of the present invention to provide a concentrated additive package composition that contains a higher molecular weight ashless dispersant than heretofore has been available due to viscosity considerations. It is also an object of the present invention to provide a process for preparing the additive package composition.

SUMMARY OF THE INVENTION

This invention relates to an oleaginous additive concentrate comprising an admixture of components (i), (ii) and (iii) wherein (i) is at least one borated or unborated ashless dispersant having a hydrodynamic radius of about 8 to 40 nm; (ii) is at least one oil-soluble overbased metal detergent; and (iii) is at least one surface-active agent having a number average molecular weight less than 600 and containing at least one hydroxyl or amino group; wherein the weight ratio of said dispersant to said detergent is about 1:1 to 8:1, the amount of said surface-active agent is about 0.1 to 20 wt. % based on the total weight of said dispersant, and the sum of the (i) and (ii) is about 30 to 60 wt. % based on the total weight of said concentrate. In the present invention, unless otherwise specified, the amount of ashless detergent, overbased detergent and other concentrate additives are on an active ingredient basis.

This invention also relates to a process for preparing the additive concentrate described above.

DETAILED DESCRIPTION

The present invention solves the problem of increased viscosity when high molecular weight dispersants and overbased metal detergents are blended by the use of a surface-active agent. The oleaginous additive concentrate of the present invention thus comprises an admixture of components (i), (ii) and (iii) wherein (i) is at least one borated or unborated ashless dispersant having a hydrodynamic radius of about 8 to 40 nm; (ii) is at least one oil-soluble overbased metal detergent; and (iii) is at least one surface-active agent having a number average molecular weight less than 600 and containing at least one hydroxyl or amino group; wherein the weight ratio of said dispersant to said detergent is about 1:1 to 8:1, the amount of said surface-active agent is about 0.1 to 20 wt. % based on the total weight of said dispersant, and the sum of the (i) and (ii) is about 30 to 60 wt. % based on the total weight of said concentrate.

It has been found that the inclusion of the surface-active agent enables the viscosity of the concentrate to be controlled within manageable limits. Without wishing to be bound by any theory, it is believed that the surface-active agent acts by competing with the ashless dispersant at the surface of the detergent colloidal structure, thereby inhibiting the growth of the detergent/dispersant complex. This decreases the size of the complex and hence inhibits the onset of the above-mentioned uncontrollable viscosity increase.

The hydrodynamic radius of the present invention is a convenient way to measure the size of the dispersant. The hydrodynamic radius is a measure of the volume of space occupied by the dispersant. The longer the hydrodynamic radius of the dispersant, the more likely it will interact with other dispersants that are complexed with the overbased metal detergent.

The concept of hydrodynamic radius is a more useful measure of the volume occupied by the dispersant than molecular weight. This is because the volume occupied by the dispersant, depends, in part, on the amount and length of branches in the polymer dispersant. A dispersant that has many branches may have a high molecular weight, but its hydrodynamic radius may not be large because a significant part of the molecular weight is concentrated in the branches. In contrast, a low molecular weight polymer dispersant may have a large hydrodynamic radius because it contains few branches and has a long polymer backbone. Therefore, a better indication of the tendency of polymer dispersants to interact is hydrodynamic radius rather than molecular weight. It is believed that the hydrodynamic radius of the dispersants used in the present invention is larger than those that have been previously used in concentrate additive packages.

The hydrodynamic radius of the dispersants may be measured by the technique of dynamic light scattering (hereinafter "DLS") which is described in B. J. Berne and R. Pecora, Dynamic Light Scattering (Krieger, Malabar, Fla., 1990) and in D. E. Dahneke, Measurement of Suspended Particles by Quasielastic Light Scattering (Wiley, N.Y., 1983). The dispersants of the present invention should be measured in heptane or other comparable solvents in concentrations of about 0.1 to 1 wt. %. For most dispersants, the measurement temperature has little impact on the measurement results, and the temperature can range from room temperature to 60° C. However, with ethylene based dispersants, the hydrodynamic radius measurement should be performed at 60° C. to eliminate association of ethylene segments.

The surface-active agent may be mixed in any order, provided that the surface-active agent is first mixed with either the dispersant or the detergent. For example, the dispersant and surface-active agent are first mixed together and then the detergent is added, or the detergent and the surface-active agent may be firstly mixed together and then added to and mixed with the dispersant. The preferred method is to mix the dispersant and surface-active agent together before blending the detergent.

In order for the concentrate to be oleaginous, the additives may be in solution in an oleaginous carrier or such a carrier may be provided separately or both. Examples of suitable carriers are oils of lubricating viscosity, such as described in detail hereinafter, and aliphatic, naphthenic and aromatic hydrocarbons.

The dispersant, detergent and surface-active agent of the present invention must be "oil-soluble" or "oil-dispersible" in the oleaginous carrier or oil of lubricating viscosity, but these descriptions do not mean that they are soluble, dissolvable, miscible or capable of being suspended in the oil in all proportions. They do mean, however, that they are stable and soluble in the oil to an extent sufficient to exert their intended effect in the environment in which the lubricating oil composition is employed. Moreover, the additional incorporation of other additives such as those described hereinafter may affect their oil-solubility or dispersability.

The concentrate of the present invention is prepared at elevated temperatures, i.e. above ambient temperature. The blending temperature should be about 50° to 150° C., preferably about 50° to 120° C., more preferably about 60° to 120° C. and even more preferably about 60° to 100° C. Although energy is saved at low temperatures, practical considerations dictate the most convenient temperature that can be used. Thus, where any additive is used that is solid at ambient temperature, it is usually more convenient to raise its temperature to a temperature at which it flows, rather than dissolving it in oil prior to addition to the other additives. Temperatures of 100° C. or more can be employed if any additive is more conveniently handled at such temperatures.

The components are advantageously held at the mixing temperature for a time sufficient to achieve a homogenous mixture thereof. This can usually be effected within ½ hr, particularly when the temperature of mixing exceeds 80° C.

One or more further lubricating oil additives, desirable for conferring a full range of properties may be added to the concentrate. These additives preferably include corrosion inhibitors, metal dihydrocarbyl dithiophosphates, antioxidants, antiwear agents. friction modifiers, viscosity modifiers, a low base number metal detergent having a TBN less than 50, and mixtures thereof. The temperature at which these further additives are added will depend on the stability of the particular additives. Preferably, the temperature for blending further additives is about 50° to 85° C.

Boron may usefully be provided in the concentrate, for example in the form of a borated ashless dispersant, or in the form of an additional boron-containing compound or both.

The concentrate of the present invention can be incorporated into a lubricating oil composition in any convenient way. Thus, they can be added directly to an oil of lubricating viscosity by dispersing or dissolving them in the oil at the desired concentrations of the dispersant and detergent, respectively. Such blending can occur at ambient temperature or elevated temperatures. Alternatively, the composite can be blended with a suitable oil-soluble solvent and base oil to form a further concentrate which is then blended with an oil of lubricating viscosity to obtain the final lubricating oil composition.

The concentrate of the present invention will typically contain (on an active ingredient (A.I.) basis) from 3 to 50 mass %, and preferably from 10 to 40 mass % dispersant additive, from 3 to 45 mass %, and preferably from 5 to 30 mass %, metal detergent additive based on the concentrate weight. The surface-active agent may be present in the concentrate at from 0.1 to 10 mass % based on the weight of dispersant. The concentrate will typically contain an ashless dispersant to overbased metal detergent ratio on an active ingredient basis of about 0.1:1 to 12:1, preferably from about 0.5:1 to 10:1, more preferably from about 1:1 to 8:1, and even more preferably about 1:1 to 4:1.

The sum of the detergent and dispersant on an active ingredient basis is typically from 20 to 70 wt. %, preferably about 25 to 65 wt. %, more preferably about 30 to 65 wt. %, even more preferably about 30 to 60 wt. %, still more preferably about 35 to 60 wt. % and even still more preferably about 40 to 60 wt. % based on the total weight of the concentrate.

The practical concentration (sum of the detergent and dispersant) will depend, in part, on the size of the dispersant. If the dispersant size is large, e.g., a hydrodynamic radius of 15 to 40 nm, the sum of the dispersant and detergent in the present invention will typically range from about 25 to 50 wt. %. If the size of the dispersant is smaller, e.g., a hydrodynamic radius of about 8 to 40 nm, the sum will typically be about 40 to 60 wt. %.

The components of the invention will now be discussed in further detail as follows:

Ashless Dispersants

The high molecular weight ashless dispersants in the concentrate of the present invention include the range of ashless dispersants known as effective for adding to lubricant oils for the purpose of reducing the formation of deposits in gasoline or diesel engines. Preferably, "high molecular weight" dispersant means having a number average molecular weight of greater than 3000, such as between 3000 and 20000. The exact molecular weight ranges will depend on the type of polymer used in the dispersants. For example, for a polyisobutylene derivatized dispersant, a high molecular weight dispersant means having a number average molecular weight of about 7000 to 20,000. A high molecular weight poly(alpha-olefin) derivatized dispersant means having a molecular weight of about 3000 to 20,000. It is believed that the high molecular dispersants of the present invention have not previously been used with overbased metal detergents in the concentrations needed to prepare a concentrate due the uncontrollable rise in viscosity during blending.

As previously discussed, a useful measure of the size of the dispersant is hydrodynamic radius ($R_H$) In the present invention, the hydrodynamic radius may range from about 8 to 40 nm, such as 10, 12 or 15 to 40 nm. It is believed that the above ranges for the dispersants are higher than those that have been previously used in concentrates.

Typical commercially available polyisobutylene based dispersants contain polyisobutylene polymers having a number average molecular weight ranging from 900 to 2300, functionalized by maleic anhydride, (MW=98), and derivatized with polyamines having a molecular weight of about 100 to 350. Each dispersant contains 1.5 to 2.5 polyisobutylene polymers per dispersant. Thus, the molecular weight of the polyisobutylene derivatized dispersant can be calculated and ranges from about 1600 to 6300. For example, with a dispersant averaging about 2.5 polymers per dispersant, the molecular weight of the dispersant can be calculated to be: 2.5 moles polyisobutylene (MW=2300)+2.5 moles maleic anhydride (MW=98)+1 mole polyamine (350) which gives a molecular weight of about 6300. For comparison, a polyisobutylene based dispersant having a number average molecular weight of about 5000 has a hydrodynamic radius of about 5.5 nm. In cases where the molecular weight of the dispersant can not be readily estimated from the molecular weight of the starting materials, e.g., in more complex chain extended systems, an empirical measurement of molecular weight and hydrodynamic radius must be made.

The ashless dispersant of the present invention comprises an oil soluble polymeric long chain hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The long chain hydrocarbyl substituted mono- or dicarboxylic acid material, i.e. acid, anhydride, or ester, used in the invention includes long chain hydrocarbon, generally a polyolefin, substituted with an average of at least about 0.8, (e.g., about 0.8 to 2.0) generally from about 1.0 to 2.0, preferably 1.05 to 1.25, 1.1 to 1.2, moles per mole of polyolefin, of an alpha or beta unsaturated $C_{.4}$ to $C_{10}$ dicarboxylic acid, or anhydride or ester thereof, such as fumaric acid, itaconic acid, maleic acid, maleic anhydride, chloromaleic acid, dimethyl fumarate, chloromaleic anhydride, acrylic acid, methacrylic acid, crotonic acid, cinnamic acid, etc.

Preferred olefin polymers for reaction with the unsaturated dicarboxylic acids are polymers comprising a major molar amount of $C_2$ to $C_{10}$, e.g. $C_2$ to $C_5$ monoolefin. Such olefins include ethylene, propylene, butylene, isobutylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; etc. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene; or a copolymer of ethylene, propylene and 1,4-hexadiene; etc.

Processes for reacting polymeric hydrocarbons with unsaturated carboxylic acids, anhydrides or esters and the preparation of derivatives from those compounds are disclosed in U.S. Pat. Nos. 3,087,936, 3,172,892, 3,215,707, 3,231,587, 3,231,587, 3,272,746, 3,275,554, 3,381,022, 3,442,808, 356,804, 3,912,764, 4,110,349, 4,234,435 and GB-A-1440219.

A preferred class of ashless dispersants are ethylene alpha-olefin copolymers and alpha-olefin homo-, co- and terpolymers prepared using new metallocene catalyst chemistry, which may have a high degree (e.g. >30%) of terminal vinylidene unsaturation is described in U.S. Pat. Nos. 5,128,056, 5,151,204, 5,200,103, 5,225,092, 5,266,223, 5,334,775; WO-A-94/19436, 94/13709; and EP-A-440506, 513157, 513211. These dispersants are described as having superior viscometric properties as expressed in a ratio of CCS viscosity to kV 100° C.

The term "alpha-olefin" is used herein to denote an olefin of the formula

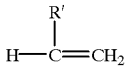

wherein R' is preferably a $C_1$–$C_{18}$ alkyl group. The requirement for terminal vinylidene unsaturation refers to the presence in the polymer of the following structure:

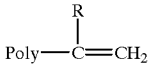

wherein Poly is the polymer chain and R is typically a $C_1$–$C_{18}$ alkyl group, typically methyl or ethyl. Preferably the polymers will have at least 50%, and most preferably at least 60%, of the polymer chains with terminal vinylidene unsaturation. As indicated in WO-A-94/19426, ethylene/1-butene copolymers typically have vinyl groups terminating no more than about 10 percent of the chains, and internal monounsaturation in the balance of the chains. The nature of the unsaturation may be determined by FTIR spectroscopic analysis, titration or C-13 NMR.

The oil-soluble polymeric hydrocarbon backbone may be a homopolymer (e.g., polypropylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, e.g., 1 to 10 mole %, is an α,ω-diene, such as a $C_3$ to $C_{22}$ non-conjugated diolefin (e.g., a copolymer of isobutylene and butadiene, or a copolymer of ethylene, propylene and 1,4-hexadiene or 5-ethylidene-2-norbornene). Atactic propylene oligomers of the present invention have a number average molecular weight of from about 3000 to 10000 may also be used as well as heteropolymers such as polyepoxides.

One preferred class of olefin polymers is polybutenes and specifically poly-n-butenes, such as may be prepared by polymerization of a $C_4$ refinery stream. Other preferred classes of olefin polymers are ethylene alpha-olefins (EAO) copolymers that preferably contain 1 to 50 mole % ethylene, and more preferably 5 to 48 mole % ethylene. Such polymers may contain more than one alpha-olefin and may contain one or more $C_3$ to $C_{22}$ diolefins. Also useable are mixtures of EAO's of varying ethylene content. Different polymer types, e.g., EAO, may also be mixed or blended, as well as polymers differing in number average molecular weight components derived from these also may be mixed or blended.

Particularly preferred copolymers are ethylene butene copolymers.

Preferably, the olefin polymers and copolymers may be prepared by various catalytic polymerization processes using metallocene catalysts which are, for example, bulky ligand transition metal compounds of the formula:

$$[L]_m M[A]_n$$

where L is a bulky ligand; A is a leaving group, M is a transition metal, and m and n are such that the total ligand valency corresponds to the transition metal valency. Preferably the catalyst is four co-ordinate such that the compound is ionizable to a $1^+$ valency state.

Such polymerizations, catalysts, and cocatalysts or activators are described, for example, in U.S. Pat. Nos. 4,530,914, 4,665,208, 4,808,561, 4,871,705, 4,897,455, 4,937,299, 4,952,716, 5,017,714, 5,055,438, 5,057,475, 5,064,802, 5,096,867, 5,120,867, 5,124,418, 5,153,157, 5,198,401, 5,227,440, 5,241,025; EP-A-129368, 277003, 277004, 420436, 520732; and WO-A-91/04257, 92/00333, 93/08199, 93/08221, 94/07928 and 94/13715, herein incorporated by reference.

The oil-soluble polymeric hydrocarbon backbone may be functionalized to incorporate a functional group into the backbone of the polymer, or as one or more groups pendant from the polymer backbone. The functional group typically will be polar and contain one or more hetero atoms such as P, O, S, N, halogen, or boron. It can be attached to a saturated hydrocarbon part of the oil-soluble polymeric hydrocarbon backbone via substitution reactions or to an olefinic portion via addition or cycloaddition reactions. Alternatively, the functional group can be incorporated into the polymer in conjunction with oxidation or cleavage of the polymer chain end (e.g., as in ozonolysis).

Useful functionalization reactions include: halogenation of the polymer at an olefinic bond and subsequent reaction of the halogenated polymer with an ethylenically unsaturated functional compound (e.g., maleation where the polymer is reacted with maleic acid or anhydride); reaction of the polymer with an unsaturated functional compound by the "ene" reaction absent halogenation; reaction of the polymer with at least one phenol group (this permits derivatization in a Mannich base-type condensation); reaction of the polymer at a point of unsaturation with carbon monoxide using a Koch-type reaction to introduce a carbonyl group in an iso or neo position; reaction of the polymer with the functionalizing compound by free radical addition using a free radical catalyst; copolymerization of the polymer with the functionalizing compound, (e.g., maleic anhydride), with or without low molecular weight olefins via free radical initiation; reaction with a thiocarboxylic acid derivative; and reaction of the polymer by air oxidation methods, epoxidation, chloroamination, or ozonolysis.

The functionalized oil-soluble polymeric hydrocarbon backbone is then further derivatized with a nucleophilic reactant such as an amine, amino-alcohol, alcohol, metal compound or mixture thereof to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g. polyalkylene and polyoxyalkylene polyamines of about 2 to 60, conveniently 2 to 40 (e.g., 3 to 20), total carbon atoms and about 1 to 12, conveniently 3 to 12, and preferably 3 to 9 nitrogen atoms in the molecule. Mixtures of amine compounds may advantageously be used such as those prepared by reaction of alkylene dihalide with ammonia. Preferred amines are aliphatic saturated amines, including, e.g., 1,2-diaminoethane; 1,3-diaminopropane; 1,4-diaminobutane; 1,6diaminohexane; polyethylene amines such as diethylene triamine; triethylene tetramine; tetraethylene pentamine; and polypropyleneamines such as 1,2-propylene diamine; and di-(1,2-propylene)triamine.

Other useful amine compounds include: alicyclic diamines such as 1,4-di(aminomethyl) cyclohexane, and heterocyclic nitrogen compounds such as imidazolines. A particularly useful class of amines are the polyamido and related amido-amines as disclosed in U.S. Pat. Nos. 4,857,217; 4,956,107; 4,963,275; and 5,229,022. Also usable is tris(hydroxymethyl)amino methane (THAM) as described in U.S. Pat. No. 4,102,798; 4,113,639; 4,116,876; and UK 989,409. Dendrimers, star-like amines, and comb-structure amines may also be used. Similarly, one may use the condensed amines disclosed in U.S. Pat. No. 5,053,152. The functionalized polymer is reacted with the amine compound according to conventional techniques as described in EP-A 208,560; U.S. Pat No. 4,234,435 and U.S. Pat. No. 5,229,022.

The functionalized oil-soluble polymeric hydrocarbon backbones also may be derivatized with hydroxy compounds such as monohydric and polyhydric alcohols or with aromatic compounds such as phenols and naphthols. Polyhydric alcohols are preferred, e.g., alkylene glycols in which the alkylene radical contains from 2 to 8 carbon atoms. Other useful polyhydric alcohols include glycerol, monooleate of glycerol, monostearate of glycerol, monomethyl ether of glycerol, pentaerythritol, dipentaerythritol, and mixtures thereof. An ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding ashless dispersants comprise the ether-alcohols and including, for example, the oxy-alkylene, oxy-arylene. They are exemplified by ether-alcohols having up to 150 oxy-alkylene radicals in which the alkylene radical contains from 1 to 8 carbon atoms. The ester dispersants may be di-esters of succinic acids or acidic esters, i.e., partially esterified succinic acids, as well as partially esterified polyhydric alcohols or phenols, i.e., esters having free alcohols or phenolic hydroxyl radicals. An ester dispersant may be prepared by one of several known methods as illustrated, for example, in U.S. Pat. No. 3,381,022.

One preferred group of dispersant is poly(alpha olefin) dispersants. They are preferably employed in the invention as polyamine-derivatized poly(alpha-olefin) dispersants having a number average molecular weight of about 3000 to 20,000, preferably about 4000 to 15,000 and more preferably about 5000 to 10,000, or a weight average molecular weight of about 6,000 to 50,000, preferably about 8,000 to 40,000 and more preferably 10,000 to 30,000. One convenient method to measure molecular weight is gel permeation chromatography (GPC), which additionally provides molecular weight distribution information (see W. W. Yau, J. J. Kirkland and D. D. Bly, "Modern Size Exclusion Liquid Chromatography", John Wiley and Sons, N.Y., 1979). Another useful method, particularly for lower molecular weight polymers, is vapor pressure osmometry (see, e.g., ASTM D3592).

In a preferred embodiment the poly(alpha olefin) dispersant is derived from an ethylene/butene alpha-olefin polymer having a number average molecular weight of about 4,000 to 15000 or a weight average molecular weight of about 8,000 to 20,000.

Another preferred group of ashless dispersants are those derived from polyisobutylene substituted with succinic anhydride groups and reacted with polyethylene amines, e.g. tetraethylene pentamine, pentaethylene e.g. polyoxypropylene diamine, trismethylolaminomethane and pentaerythritol, and combinations thereof. One particularly preferred dispersant combination involves a combination of (A) polyisobutylene substituted with succinic anhydride groups and reacted with (B) a hydroxy compound, e.g. pentaerythritol, (C) a polyoxyalkylene polyamine, e.g. polyoxypropylene diamine, or (D) a polyalkylene polyamine, e.g. polyethylene diamine and tetraethylene pentamine using about 0.3 to about 2 moles either (B), (C) or (D) per mole of A. Another preferred dispersant combination involves the combination of (A) polyisobutenyl succinic anhydride with (B) a polyalkylene polyamine, e.g. tetraethylene pentamine, and (C) a polyhydric alcohol or polyhydroxy-substituted aliphatic primary amine, e.g. pentaerythritol or trismethylolaminomethane as described in U.S. Pat. No. 3,632,511.

Preferably, the polyamine-derivatized polyisobutylene dispersant has a number average molecular weight of about 7000 to 20000, preferably about 9000 to 20,000 and more preferably about 12,000 to 20,000, or a weight average molecular weight of about 17,000 to 50,000, preferably about 20,000 to 40,000 and more preferably about 25,000 to 40,000.

Another class of ashless dispersants comprises Mannich base condensation products. Generally, these are prepared by condensing about one mole of an alkyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808. Such Mannich condensation products may include a polymer product of a metallocene catalyzed polymerization as a substituent on the benzene group or may be reacted with a compound containing such a polymer substituted on a succinic anhydride, in a manner similar to that shown in U.S. Pat. No. 3,442,808.

Examples of functionalized and/or derivatized olefin polymers based on polymers synthesized using metallocene catalyst systems are described in publications identified above.

The dispersant can be further post-treated by a variety of conventional post treatments such as boration, as generally taught in U.S. Pat. Nos. 3,087,936 and 3,254,025. This is readily accomplished by treating an acyl nitrogen-containing dispersant with a boron compound selected from the group consisting of boron oxide, boron halides, boron acids and esters of boron acids, in an amount to provide from about 0.1 atomic proportion of boron for each mole of the acylated nitrogen composition to about 20 atomic proportions of boron for each atomic proportion of nitrogen of the acylated nitrogen composition. Usefully the dispersants contain from about 0.05 to 2.0 wt. %, e.g. 0.05 to 0.7 wt. % boron based on the total weight of the borated acyl nitrogen compound. The boron, which appears be in the product as dehydrated boric acid polymers (primarily $(HBO_2)_3$), is believed to attach to the dispersant imides and diimides as amine salts e.g., the metaborate salt of the diimide. Boration is readily carried out by adding from about 0.05 to 4, e.g., 1 to 3 wt. % (based on the weight of acyl nitrogen compound) of a boron compound, preferably boric acid, usually as a slurry, to the acyl nitrogen compound and heating with stirring at from 135° to 190° C., e.g., 140°–170° C., for from 1 to 5 hours followed by nitrogen stripping. Alternatively, the boron treatment can be carried out by adding boric acid to a hot reaction mixture of the dicarboxylic acid material and amine while removing water.

Also, boron may be provided separately, for example as a boron ester or as a boron succinimide, made for example from a polyisobutylene succinic anhydride, where the polymer has a molecular weight of from about 450 to 700.

Oil-Soluble Metal Detergent

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as may be measured by ASTM D2896) of from 0 to 80. It is possible to include large amounts of a metal base by reacting an excess of a metal compound such as an oxide or hydroxide with an acidic gas such as carbon dioxide. The resulting overbased detergent comprises neutralized detergent as the outer layer of a metal base (e.g. carbonate) micelle. The detergents of the present invention are overbased detergents that have a TBN of 150 or greater, and typically from about 250 to 450 or more.

Detergents that may be used in the present invention include oil-soluble overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are overbased calcium sulfonates, calcium phenates and sulfurized phenates and salicylates having a TBN of about 150 to 450. In the practice of the present invention, combinations of surfactants, e.g., sulfonates and phenates, and combination of overbased and neutral detergents may also be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaqphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt % (preferably at least 125 wt %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

The detergent may have a particle diameter size in the range of about 4 to 40 nm, preferably about 4 to 30 nm and more preferably about 6 to 20 nm. The overbased metal dispersant diameter size can be measured using the small angle neutron scattering technique as described in I. Markovic, R. H. Ottewill, D. J. Cebula, I. Field and J. F. Marsh, "Small angle neutron scattering studies on non-aqueous dispersions of calcium carbonate", Colloid & Polymer Science, 262:648–656 (1984).

Surface-Active Agents

The surface-active agents of the present invention are of lower molecular weight than the ashless dispersant, e.g. about 600 or less and contain at least one polar group selected from hydroxyl and amine groups. The surface-active agents should be oil-soluble and have sufficient stability to survive the preparation conditions of the composite and the subsequent conditions of use to which the lubricant oil is subjected. The volatility of the additive should be sufficiently low to enable preparation of the composite without substantial volatilization of the additive. The additive may be one whose sole purpose in the composition is to provide viscosity control, particularly in the preparation of the concentrate. Alternatively, the additive may be a component which has a secondary purpose in the lubricant oil. For example, components such as antioxidants or friction modifiers containing polar groups, such as hydroxy groups, may be used. Such components may already be used in lubricant oil compositions for the known secondary purpose but have not previously been used in the preparation of a concentrate.

Examples of oil soluble surface-active agents are alcohols and their partial esters, phenols, carboxylic acids and primary and secondary aliphatic amines. Suitable alcohols include aliphatic alcohols containing at least six carbon atoms, with the proviso that the conditions of preparing the composite are such that significant volatilization of the alcohol does not occur during the preparation. It is preferred that the alcohol should contain at least 6 carbon atoms, such as 10 to 12 and higher because the mixing is effected at an elevated temperature, preferably at least 50° C., and desirably at least 80° C. Such alcohols may, for example, be mono-, di- or trihydric and, where polyhydric, may be partially esterified. Similar considerations apply to the choice of additives containing amino groups.

The equivalent weight of the hydroxyl containing surface-active agents is in the range of about 100 to 400. When the surface-active agent contains an amino-group, its equivalent weight may be in the range of about 200 to 600. For the present invention, equivalent weight is defined to mean the molecular weight of the dispersant divided by the number of moles of amino or hydroxyl groups in the surface-active agent (Mn/(number of amino groups+number of hydroxyl groups).

Additives which are suitable for controlling viscosity in the process and which have an additional function in the lubricating oil include hindered phenol antioxidants, such as 2,4,6-t-butyl phenol, and friction modifiers, such as glycerol mono-oleate.

The preferred surface-active agents are glycerol monooleate, nonyl phenol, nonyl phenol sulfide, dodecyl phenol, ethoxylated tallow amine (N-alkyl-diethanolamine), ethoxylated tallow ether amine (N-alkoxy propyl-diethanolamine), tridecanol, isodecanol and mixtures thereof.

The amount of the surface-active agent in the present invention on an active ingredient basis is about 0.1 to 25 wt. %, preferably about 0.1 to 20 wt. %, and more preferably about 0.1 to 10 wt. % based on the total weight of the dispersant.

Oil of Lubricating Viscosity

The oil of lubricating viscosity, useful for making concentrates of the invention or for making lubricating oil compositions therefrom, may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil, and heavy duty diesel oil. Generally, the viscosity of the oil ranges from 2 centistokes to 30 centistokes, especially 5 centistokes to 20 centistokes, at 100° C.

Natural oils include animal oils and vegetable oils (e.g., castor, lard oil) liquid petroleum oils and hydrorefined, solvent-treated or acid-treated mineral lubricating oils of the paraffinic, napthenic and mixed paraffinic-napthenic types. Oils of lubricating viscosity derived from coal or shale are also useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly (1-decenes)); alkylbenzenes (e.g., dodecylbenzenes, tetradecylbenzenes, dinonylbenzenes, di(2-ethylhexyl) benzenes); polyphenyls (e.g., biphenyls, terphenyls, alkylated polyphenols); and alkylated diphenyl ethers and alkylated diphenyl sulfides and the derivatives; analogs and homologs thereof. Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methylpolyisopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, subericacid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, dilsooctyl azelate, disodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyakoxy-, or polyaryloxysiloxne oils and silicate oils comprise another useful class of synthetic lubricants; they include tetraethyl silicate, tetraisopropyl silicate, tetra-(2-ethylhexyl)silicate, tetra-(4-methyl-2-ethylhexyl)silicate, tetra-(p-tert-butyl-phenyl)silicate, hexa-(4-methyl-2-pentoxy)disiloxane, poly(methyl)siloxanes and poly (methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

Other Additive Components

As indicated above, additional additives may be incorporated in the composites of the invention to enable them to meet particular requirements. Examples of additives which may be included in the lubricating oil compositions are metal rust inhibitors, viscosity index improvers, corrosion inhibitors, other oxidation inhibitors, friction modifiers, other dispersants, anti-foaming agents, anti-wear agents, pour point depressants, and rust inhibitors. Some are discussed in further detail below.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to use of an excess of the basic zinc compound in the neutralization reaction.

The preferred zinc dihydrocarbyl dithiophosphates are oil soluble salts of dihydrocarbyl dithiophosphoric acids and may be represented by the following formula:

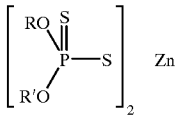

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, l-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulphide, oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. While these materials may be used in small amounts, preferred embodiments of the present invention are free of these compounds. They are preferably used in only small amounts, i.e., up to 0.4 wt %, or more preferably avoided altogether other than such amount as may result as an impurity from another component of the composition.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulphur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil soluble aromatic amines having at least two aromatic groups attached directly to one amine nitrogen should preferably not exceed 0.4 wt % active ingredient.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

Friction modifiers and fuel economy agents which are compatible with the other ingredients of the final oil may also be included. Examples of such materials are glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine. The friction modifiers identified above may also be used as surface-active agents.

A viscosity index improver dispersant functions both as a viscosity index improver and as a dispersant. Examples of viscosity index improver dispersants include reaction products of amines, for example polyamines, with a hydrocarbyl-substituted mono -or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated monocarboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralized with an amine, hydroxyamine or an alcohol; or a polymer of ethylene with a $C_3$ to $C_{20}$ olefin further reacted either by grafting a $C_4$ to $C_{20}$ unsaturated nitrogen—containing monomer thereon or by grafting an unsaturated acid onto the polymer backbone and then reacting carboxylic acid groups of the grafted acid with an amine, hydroxy amine or alcohol.

Examples of dispersants and viscosity index improver dispersants may be found in European Patent Specification No. 24146 B.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

When lubricating compositions contain one or more of the above-mentioned additives, each additive is typically blended into the base oil in an amount, which enables the additive to provide its desired function.

The amount of the above mentioned additives, other than the overbased metal detergent, ashless dispersant, surface active agent and diluent oil, can range from about 0.1 to 50 wt. %, preferably about 0.2 to 40 wt. %, more preferably about 0.5 to 30 wt. % and even more preferably about 1 to 20 wt. % and still more preferably about 1 to 10 wt. %.

The concentrate may be further added to a lubricating oil in concentration resulting in a final lubricating oil composition which may employ from 5 to 25 mass %, preferably 5 to 18 mass %, typically 10 to 15 mass % of the concentrate, the remainder being oil of lubricating viscosity. Representative effected amounts of such additives, when used in crankcase lubricants, are listed below. All the values listed are stated as mass percent active ingredient.

| ADDITIVE | MASS % (Broad) | MASS % (Preferred) |
|---|---|---|
| Ashless Dispersant | 0.1–20 | 1–8 |
| Metal Detergents | 0.1–15 | 0.2–9 |
| Corrosion Inhibitor | 0–5 | 0–1.5 |
| Metal Dihydrocarbyl Dithiophosphate | 0.1–6 | 0.1–4 |
| Antioxidant | 0–5 | 0.01–2 |
| Pour Point Depressant | 0.01–5 | 0.01–1.5 |
| Antifoaming Agent | 0–5 | 0.001–0.15 |
| Supplemental Antiwear Agents | 0–1.0 | 0–0.5 |
| Friction Modifier | 0–5 | 0–1.5 |
| Viscosity Modifier | 0.01–10 | 0.25–3 |
| Basestock | Balance | Balance |

All weight percents expressed herein (unless otherwise indicated) are based on active ingredient (A.I.) content of the additive, and/or upon the total weight of any additive-package, or formulation which will be the sum of the A.I. weight of each additive plus the weight of total oil or diluent.

EXAMPLE 1

Blend Components

In the following example, oleaginous additive concentrates were made by blending the following dispersant and detergents.

A dispersant was made by functionalizing an ethylene-butene copolymer (46 wt. % ethylene) with a carbonyl group introduced by Koch reaction, derivatized with polyamine and borated according to the procedure described in WO-A-94/13709. The number average molecular weight of the dispersant was approximately 6000 and the hydrodynamic radius, as measured by the dynamic light scattering technique at 60° C., was approximately 30 to 40 nm. A overbased detergent containing magnesium sulfonate with a TBN of 400 and a diameter of 10±2 nm as measured by the small angle neutron scattering technique. The weight ratio of the ashless dispersant to the overbased detergent was 4:1 and the sum of the detergent and dispersant on an active ingredient basis is 42 wt. % based on the total weight of the concentrate.

EXAMPLE 2

Blending Procedure

The oleaginous concentrate blending procedure was performed at 100° C. by first mixing the surface-active agent with the dispersant and then adding the detergent to the mixture. The blend was mixed for approximately 5 hours and then a sample was taken to measure the viscosity (if possible). In addition, the blend was observed for the Weissenberg effect. The blending results with various surface-active agents are shown in Table 1 below:

TABLE 1

| Surface-active Agent | WT %* | Blending Viscosity (cSt, 100° C.) | Weissenberg effect observed |
|---|---|---|---|
| Glycerol monooleate | 5 | 1497 | No |
| Glycerol monooleate | 2.5 | 3775 | No |
| Glycerol monooleate | 1.0 | 11,207 | Small |
| Ethoxylated tallow ether amine | 5 | 771 | No |
| Ethoxylated tallow ether amine | 2.5 | 1453 | No |
| Ethoxylated tallow ether amine | 1.0 | 6216 | Small |
| Ethoxylated tallow amine | 5 | 705 | No |
| Nonyl phenol sulfide | 5 | 17560 | Small |
| Diphenyl amine | 5 | 30,832 | Large |
| No Agent (Control) | N/A | >100,000 | Large |

*Weight percent surface-active agent based on total weight of the dispersant.

EXAMPLE 3

Blend Components

In the following example, oleaginous additive concentrates were made by blending the following dispersant and detergents.

A dispersant was made by functionalizing an ethylene-butene copolymer (46 wt. % ethylene) with a carbonyl group introduced by Koch reaction, derivatized with polyamine and borated according to the procedure described in WO-A-94/13709. The number average molecular weight of the dispersant was approximately 6500. The hydrodynamic radius is estimated to be approximately 34 to 40 nm.

An overbased detergent was used containing a mixture of magnesium sulfonate with a TBN of 400 and calcium sulfonate with a TBN of 300. The weight ratio of the calcium sulfonate to the magnesium sulfonate was 2.2:1.

The weight ratio of the dispersant to the detergent was 3.75:1 and the sum of the detergent and dispersant on an active ingredient basis is 51 wt. % based on the total weight of the concentrate.

EXAMPLE 4

Blending Procedure

The oleaginous concentrate blending procedure was performed at 100° C. by first mixing the surface-active agent with the dispersant and then adding the detergent mixture to the blend. The blend was mixed for approximately 3 hours and then a sample was taken to measure the viscosity (if possible). In addition, the blend was observed for the Weissenberg effect. The blending results with various surface-active agents are shown in Table 2 below:

TABLE 2

| Surface-active Agent | WT %* | Blending Viscosity (cSt, 100° C.) | Weissenberg effect observed |
|---|---|---|---|
| Nonyl phenol | 5 | (Not measured) | No |
| Nonyl phenol | 10 | 1726 | No |
| Nonyl phenol | 20 | 477 | No |
| Dodecyl phenol | 5 | 791 | No |
| Dodecyl phenol | 10 | (Not measured) | No |
| Tridecanol | 5 | 1129 | No |
| Tridecanol | 10 | 526 | No |

TABLE 2-continued

| Surface-active Agent | WT %* | Blending Viscosity (cSt, 100° C.) | Weissenberg effect observed |
|---|---|---|---|
| Isodecanol | 5 | (Not measured) | No |
| No Agent (Control) | N/A | >100,000 | Large |

*Weight percent surface-active agent based on total weight of the dispersant.

The results in Table 1 and 2 show that when no surface-active agent is present, the viscosity of the concentrate blend is uncontrollably high, and a large Weissenberg effect is observed. However, when the surface-active agents are present, the viscosity of the concentrate blend is unexpectedly and significantly lowered, and most show no Weissenberg effect. Even small amounts of surface-active agent dramatically lower the viscosity of the concentrate blend. The diphenylamine does reduce the viscosity of the blend, but still shows a large Weissenberg effect. However, diphenylamine is an aromatic amine and not one of the preferred surface-active agents of the present invention. Based on these results, it has been shown that with the addition of surface-active agents, it is now possible to used high molecular weight dispersants and overbased detergents at concentrations used in additive packages.

The foregoing is illustrative of the present invention and is not construed as limiting thereof. The invention is defined by the following claims with equivalents of the claims to be included therein.

What is claimed is:

1. A process for preparing an oleaginous additive concentrate comprising the step of blending components (i), (ii) and (iii) at a temperature greater than about 60° C. to 120° C. wherein (i) is at least one unborated ashless dispersant having a hydrodynamic radius of about 8 to 40 nm; (ii) is at least one oil-soluble overbased metal detergent; and (iii) is at least one surface-active agent having a number average molecular weight less than 600 and containing at least one hydroxyl or amino group; wherein the weight ratio of said dispersant to said detergent is about 1:1 to 8:1, the amount of said surface-active agent is about 0.1 to 20 wt. % based on the total weight of said dispersant, and the sum of components (i) and (ii) on an active ingredient basis is about 30 to 60 wt % based on the total weight of said concentrate.

2. The process of claim 1 wherein said concentrate is subsequently admixed with one or more further lubricating oil additives.

3. The process of claim 2 wherein said surface-active agent is admixed with said dispersant prior to admixing with said detergent.

4. The process of claim 3 wherein said dispersant is borated instead of unborated and has a hydrodynamic radius of 15 to 40 nm.

5. The process of claim 3 wherein said dispersant has a hydrodynamic radius of about 10 to 40 nm.

6. The process of claim 3 wherein said dispersant has a hydrodynamic radius of about 15 to 40 nm.

7. The process of claim 3 wherein the metal detergent has a diameter of about 4 to 40 nm.

8. The process of claim 3 wherein said overbased detergents are alkali or alkaline earth metal salts of sulfonates, phenates, sulfurized phenates, thiophosphonates, salicylates or napthenates.

9. The process of claim 3 wherein said surface-active agents are selected from the group consisting of alcohols and their partial esters, and aliphatic amines.

10. The process of claim 3 wherein said surface-active agent is a hydroxyl group-containing compound having an equivalent weight of about 100 to 400.

11. The process of claim 3 wherein said surface-active agent is an amino group-containing compound having an equivalent weight of about 200 to 600.

12. The process of claim 3 wherein said surface-active agents are selected from the group consisting of: glycerol monooleate, nonyl phenol, nonyl phenol sulfide, dodecyl phenol, ethoxylated tallow amine, ethoxylated tallow ether amine, tridecanol, isodecanol and mixtures thereof.

13. The process of claim 3 wherein said ashless dispersant is a derived from polyisobutylene.

14. A lubricating oil composition prepared by admixing said concentrate prepared by the process of claim 3 with a basestock of lubricating viscosity.

15. A process for preparing an oleaginous additive concentrate suitable for use in making a lubricating oil composition comprising the step of blending components (i), (ii) and (iii) at a temperature greater than about 60° C. to 120° C. wherein (i) is at least one borated or unborated ashless polyamine-derivatized polymer dispersant selected from the group consisting of a poly(isobutylene) dispersant having a number average molecular weight of about 7000 to 20,000 or a weight average molecular weight of about 17,000 to 50,000, and a poly(alpha-olefin) dispersant having a number average molecular weight of about 3000 to 20,000 or a weight average molecular weight of about 6,000 to 50,000; (ii) is at least one oil-soluble overbased metal detergent; and (iii) is at least one surface-active agent having a number average molecular weight less than about 600 containing at least one hydroxyl or amino group; wherein the weight ratio of said dispersant to said detergent is about 1:1 to 8:1, the amount of said surface-active agent is 0.1 to 20 wt. % based on the total weight of said dispersant, and the sum of components (i) and (ii) is about 30 to 60 wt % based on the total weight of said concentrate.

16. The process of claim 15 wherein said poly(alpha-olefin) dispersant has a number average molecular weight of about 5000 to 10,000 or a weight average molecular weight of about 10,000 to 30,000.

17. The process of claim 15 wherein said poly(alpha olefin) dispersant is derived from an ethylene/butene alpha-olefin polymer, wherein said dispersant has a number average molecular weight of about 4,000 to 15,000 or a weight average molecular weight of about 8,000 to 40,000.

18. The process of claim 15 wherein said surface-active agent is admixed with said dispersant prior to admixing with said detergent.

19. The process of claim 18 wherein said dispersant is borated and has a hydrodynamic radius of 15 to 40 nm.

20. The process of claim 18 wherein said metal detergent has a diameter size of about 4 to 40 nm.

21. The process of claim 18 wherein said surface-active agent is a hydroxyl group-containing compound having an equivalent weight of about 100 to 400.

22. The process of claim 18 wherein said surface-active agent is an amino group-containing compound having an equivalent weight of about 200 to 600.

23. The process of claim 18 wherein said surface-active agent is selected from the group consisting of: glycerol monooleate, nonyl phenol, nonyl phenol sulfide, dodecyl phenol, ethoxylated tallow amine, ethoxylated tallow ether amine, tridecanol, isodecanol and mixtures thereof.

24. The process of claim 18 wherein said overbased detergents are alkali or alkaline earth metal salts of sulfonates, phenates, sulfurized phenates, thiophosphonates, salicylates or napthenates.

25. A lubricating oil composition prepared by admixing said concentrate prepared by the process of claim 18 with a basestock of lubricating viscosity.

* * * * *